US007607434B2

(12) United States Patent
Laib et al.

(10) Patent No.: US 7,607,434 B2
(45) Date of Patent: Oct. 27, 2009

(54) SELF-DONNING SUPPLEMENTAL OXYGEN

(75) Inventors: Trevor M. Laib, Woodinville, WA (US); Bradley J. Mitchell, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 630 days.

(21) Appl. No.: 11/196,604

(22) Filed: Aug. 3, 2005

(65) Prior Publication Data

US 2007/0068520 A1 Mar. 29, 2007

(51) Int. Cl.
*A62B 7/00* (2006.01)

(52) U.S. Cl. ..... 128/202.19; 128/201.29

(58) Field of Classification Search .....
128/201.22–201.29, 202.12, 202.13, 202.19, 128/205.12, 205.28
See application file for complete search history.

(56) References Cited

U.S. PATENT DOCUMENTS 1,164,202 A 12/1915 Lockwood
4,221,216 A * 9/1980 Kranz ..... 128/201.23
4,481,945 A * 11/1984 Levine ..... 128/206.27
4,766,893 A * 8/1988 Drews ..... 128/201.29
5,113,854 A * 5/1992 Dosch et al. ..... 128/201.23
5,115,804 A * 5/1992 Brookman ..... 128/201.22
5,664,566 A 9/1997 McDonald et al.
6,340,024 B1 * 1/2002 Brookman et al. ..... 128/201.25
6,526,967 B2 3/2003 Cordero et al.

* cited by examiner

*Primary Examiner*—Steven O Douglas
(74) *Attorney, Agent, or Firm*—Rozenblat IP LLC

(57) ABSTRACT

A supplemental oxygen system and method is set forth for providing oxygen to an occupant of a pressurized aircraft. A flexible hood may be adapted to be stowed in a small volume when the flexible hood is deflated and may be further adapted to cover at least a portion of the head of the occupant and to provide a flow of oxygen to the occupant when the flexible hood is inflated. A source of oxygen may be adapted to rapidly inflate and deploy the flexible hood.

32 Claims, 6 Drawing Sheets

SELF-DONNING SUPPLEMENTAL OXYGEN

BACKGROUND OF THE INVENTION

1. Field of the Invention

The invention is generally directed to supplemental oxygen systems, and more particularly, to supplemental oxygen systems for aircraft.

2. Background Description

Modern aircraft operate at altitudes at which there is insufficient oxygen to sustain normal human conscious activities. A recent National Transportation Safety Board Aircraft Accident Brief (NTSB/AAB-00/01 at 6, fn 11) provides background information on this topic:

> Pressurized aircraft cabins allow physiologically safe environments to be maintained for flight crew and passengers during flight at physiologically deficient altitudes. (At altitudes above 10,000 feet, the reduction in the partial pressure of oxygen impedes its ability to transfer across lung tissues into the bloodstream to support the effective functioning of major organs, including the brain. These altitudes are typically referred to as "physiologically deficient altitudes.") At cruising altitudes, pressurized cabins of turbine-powered aircraft typically maintain a consistent environment equivalent to that of approximately 8,000 feet by directing engine bleed air into the cabin while simultaneously regulating the flow of air out of the cabin. The environmental equivalent altitude is referred to as "cabin altitude."

Current rules of operation for Transport Category airplanes, FAR 121.333 require a pilot to don and use an oxygen mask whenever the airplane is above 25,000 feet and the pilot is alone on the flight deck, and require at least one pilot to don and use oxygen at all times when the airplane is above 41,000 feet.

Similarly, for pressurized commuter and on demand aircraft operations, FAR 135.89 require a pilot to don and use an oxygen mask whenever the airplane is above 25,000 feet and the pilot is alone on the flight deck, and require at least one pilot to don and use oxygen at all times when the airplane is above 35,000 feet.

These requirements exist because external air pressure at cruise altitude is below the oxygen pressure in the pilot's bloodstream. In the event the cabin lost pressurization, the pilot would rapidly loose consciousness due to hypoxia. The "time of useful consciousness" following a loss of pressurization is shown in Table 1 below.

TABLE 1

| Altitude (ft) | Time of useful consciousness without supplemental oxygen | Ambient pressure of air (psi) | Partial pressure of 21% oxygen (psi) | Partial pressure of 50% oxygen (psi) |
|---|---|---|---|---|
| 40,000 | 15 seconds | 2.72 | 0.57 | 1.36 |
| 35,000 | 20 seconds | 3.45 | 0.73 | 1.73 |
| 30,000 | 30 seconds | 4.36 | 0.92 | 2.18 |
| 28,000 | 1 minute | 4.77 | 1.00 | 2.39 |
| 26,000 | 2 minutes | 5.22 | 1.10 | 2.61 |
| 24,000 | 3 minutes | 5.69 | 1.20 | 2.85 |
| 22,000 | 6 minutes | 6.20 | 1.30 | 3.10 |
| 20,000 | 10 minutes | 6.75 | 1.42 | 3.37 |
| 15,000 | Indefinite | 8.29 | 1.74 | 4.15 |

Source: "Physiologically Tolerable Decompression Profiles for Supersonic Transport Type Certification," Office of Aviation Medicine Report AM' 70-12, S. R. Mohler, M. D., Washington, D.C.; Federal Aviation Administration, July 1970.

An oxygen mask provides a means of supplying 50% or 100% oxygen to the pilot at ambient or near-ambient pressure. Oxygen naturally comprises 21% of the air which, at 15,000 ft., exerts a partial pressure of approximately 1.74 psi. As shown in Table (1) above, the same partial pressure may be provided at 35,000 ft with 50% oxygen, or above 40,000 ft with 100% oxygen (see "Ambient pressure" column above). This is how an oxygen mask provides an extended time of useful consciousness in an unpressurized airplane at cruise altitudes.

During a decompression event at high altitudes, it is conceivable a single pilot, trying to handle an emergency unassisted, could lose consciousness before he or she would be able to don an oxygen mask. Thus the requirement to wear an oxygen mask for any pilot alone on the flight deck.

Even with the development of quick-donning oxygen masks, the brief time between a rapid loss of aircraft cabin pressure and the donning and activation of an oxygen mask may be too long to ensure adequate oxygen for the pilot to safely control the aircraft and avoid losing consciousness. As noted by the NTSB: "Research has shown that a period of as little as 8 seconds without supplemental oxygen following rapid depressurization to about 30,000 feet may cause a drop in oxygen saturation that can significantly impair cognitive functioning and increase the amount of time required to complete complex tasks." NTSB/AAB-00/01 at 34.

Accordingly, there is a need for improved systems for providing supplemental oxygen to aircraft crew members. The present invention is directed to overcoming one or more of the problems or disadvantages associated with the prior art.

SUMMARY OF THE INVENTION

This invention provides apparatuses and methods for providing oxygen to a pilot or other crewmember in an emergency such as decompression or loss of pressurization, without requiring the pilot to continuously wear an uncomfortable breathing mask.

Some embodiments of this invention may also be used to provide a self-donning smoke hood function in the event of fire on the airplane.

The features, functions, and advantages may be achieved independently in various embodiments of the present invention or may be combined in yet other embodiments.

DETAILED DESCRIPTION

This invention may include a transparent flexible hood made in one or more parts, and that may be connected to a number of inflatable tubes. The entire assembly may be collapsed into a flat package.

The invention may include incorporation of a hood into an overall emergency oxygen system for an aircraft such that, for example, when a loss of pressure is detected, a warning alarm sounds. If the pilot does not quickly disarm the system, oxygen or oxygen-enriched air is released into the inflatable tubes, which become rigid, and pull/push the connected oxygen hood from its storage location. The hood may be configured such that when the tubes are fully inflated, the hood closes around the pilot's head. Oxygen or oxygen-enriched air is released into the hood for the pilot to breathe.

The hood does not need to seal tightly around the pilot's head, as the hood is not pressurized. Small gaps around the edges of the hood will not impair function. In fact, small gaps are necessary to exhaust the pilot's exhaled air. Large gaps, however, may impair function unless the oxygen flow is increased to compensate.

These self-donning oxygen systems may be configured to deploy automatically, with no input required by the user. Thus, the system will deploy and function even of the user is unconscious. These systems not only deploy and operate on an unconscious user, but supply a sufficient amount of oxygen for the user to regain consciousness and thus, regain control of the aircraft.

Variations of the self-donning oxygen system according to the invention may include some or all of the features of the following embodiments.

Figure 1:
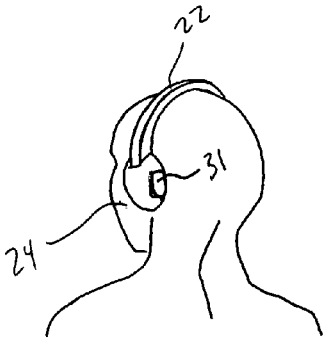
FIG. 1 is a rear perspective view of a self-donning oxygen mask that may be stowed in a radio headset, in a stowed configuration.
Figure 2:
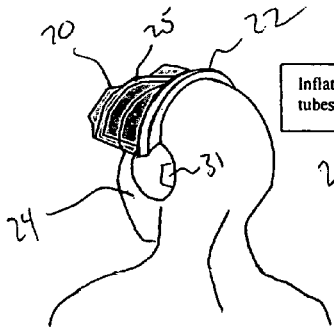
FIG. 2 is a rear perspective view of the self-donning oxygen mask of FIG. 1, in a partially deployed configuration.
Figure 3:
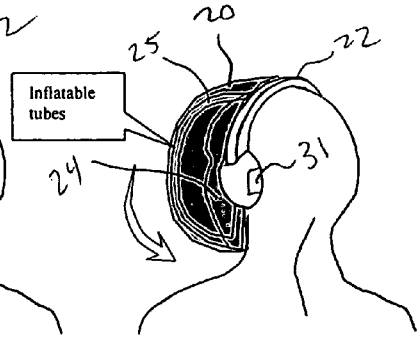
FIG. 3 is a rear perspective view of the self-donning oxygen mask of FIG. 1, in a fully deployed configuration.

With reference to FIGS. 1 through 3, a transparent oxygen hood 20 may be stowed in a pilot's radio headset 22, and deployed forward to cover a pilot's face 24 when activated by a sensor system 31. The sensor system 31 is in fluid communication with the cabin atmosphere and monitors the cabin pressure. If the cabin pressure falls below a predetermined threshold, the warning alarm is activated and if the pilot does not disarm the sensor system 31 in a predetermined amount of time, the sensor system 31 activates the transparent oxygen hood 20. Of course, the sensor system 31 may be remotely located from the transparent oxygen hood 20 and may activate the transparent oxygen hood 20 wirelessly. FIGS. 2 and 3 depict a deployment of the transparent oxygen hood 20. The transparent oxygen hood 20 may include inflatable tubes 25 that add rigidity and help give a consistent shape to the transparent oxygen hood 20. The tubes 25 may be inflated with gas from the aircraft oxygen supply, a separate gas supply, such as, a separate pressurized oxygen tank or a small canister of carbon dioxide (e.g., the small pressurized carbon dioxide canisters used to inflate life vests or used in pellet guns). Of course, other devices may be used to inflate the hood, such as, for example, resilient wires, springs, flexible resilient fabrics, etc. The transparent oxygen hood 20 does not need to seal tightly around the pilot's face 24 to function properly. This configuration may require the pilot to continually wear the radio headset 22 when alone on the flight deck, in order to comply with aviation regulations.

The oxygen-enriched air supplied to the transparent oxygen hood 20 may be supplied from one or more small internal cylinders (not shown). The small internal cylinders may contain oxygen-enriched air or may contain 100% oxygen which is mixed with ambient air, using an induction pump (not shown), for example, to produce an oxygen-enriched air supply. This configuration may be incorporated into the headset 22. However, the small internal cylinders would become depleted over time. At some point after the loss of pressurization, the pilot would have to connect the transparent oxygen hood 20 to an oxygen supply line (not shown), or remove it to don a normal oxygen mask when time permits.

Figure 4:
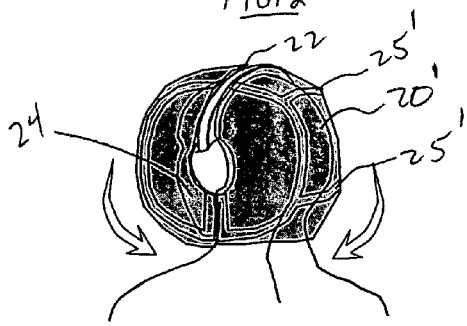
FIG. 4 is a rear perspective view of a self-donning oxygen mask that deploys in a clamshell fashion.

According to another embodiment of the invention, a transparent oxygen hood 20' may deploy from the radio headset 22 in two parts, closing in a clamshell fashion around the pilot's head, or head and neck, as depicted in FIG. 4. The transparent oxygen hood 20' may include inflatable tubes 25'.

Figure 5:
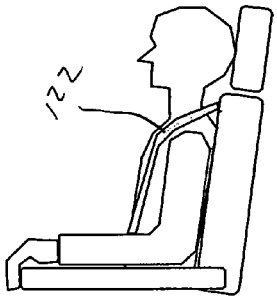
FIG. 5 is a side elevational view of a self-donning oxygen mask that may be stowed in a shoulder harness, in a stowed configuration.
Figure 6:
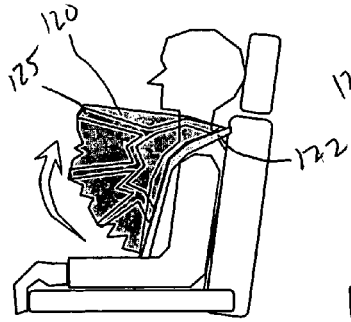
FIG. 6 is a side elevational view of the self-donning oxygen mask of FIG. 5, in a partially deployed configuration.
Figure 7:
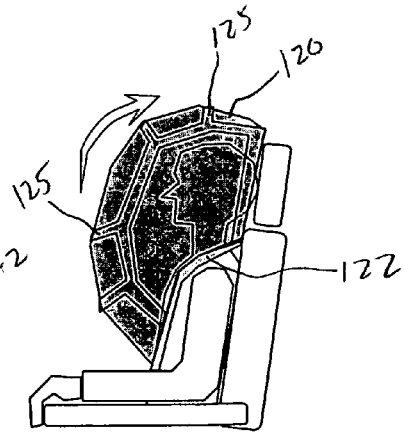
FIG. 7 is a side elevational view of the self-donning oxygen mask of FIG. 5, in a fully deployed configuration.
Figure 8:
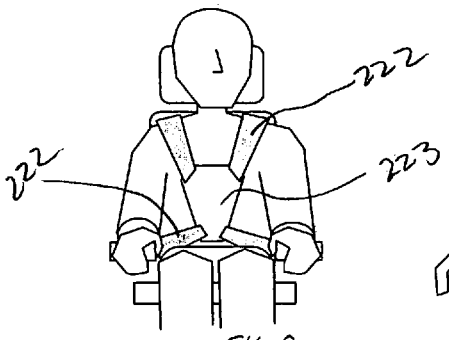
FIG. 8 is a front elevational view of a self-donning oxygen mask that may be stowed in a chest pack or seat belt buckle, in a stowed configuration.
Figure 9:
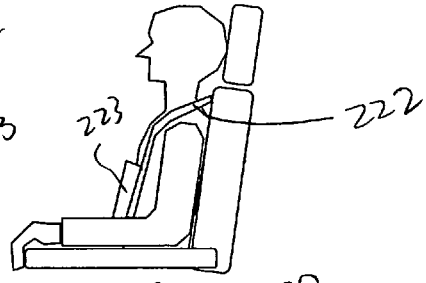
FIG. 9 is side elevational view of the self-donning oxygen mask of FIG. 8, in a stowed configuration.
Figure 10:
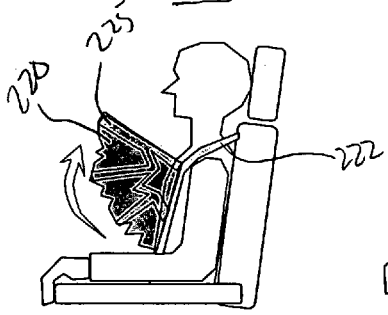
FIG. 10 is a side elevational view of the self-donning oxygen mask of FIG. 8, in a partially deployed configuration.
Figure 11:
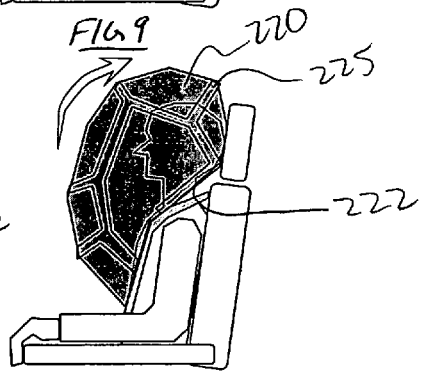
FIG. 11 is a side elevational view of the self-donning oxygen mask of FIG. 8, in a fully deployed configuration.
Figure 12:
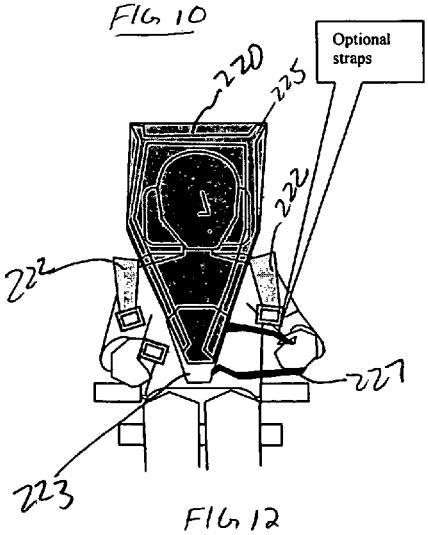
FIG. 12 is a front elevational view of the self-donning oxygen mask of FIG. 8, in a fully deployed configuration and partially disconnected from the seat belts and shoulder harnesses.
Figure 13:
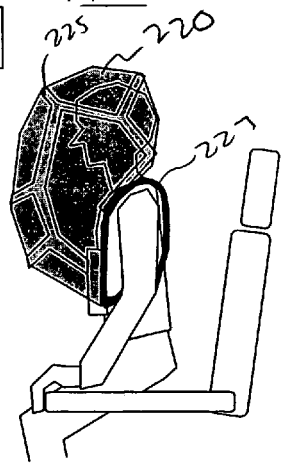
FIG. 13 is a side elevational view of the self-donning oxygen mask of FIG. 8, in a fully deployed configuration and completely disconnected from the seat belts and shoulder harnesses.
Figure 14:
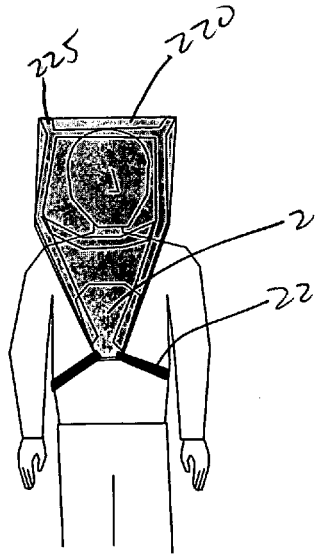
FIG. 14 is a front elevational view of the self-donning oxygen mask of FIG. 8 in a fully deployed configuration, completely disconnected from the seatbelts and shoulder harnesses, and with securing body straps installed.
Figure 15:
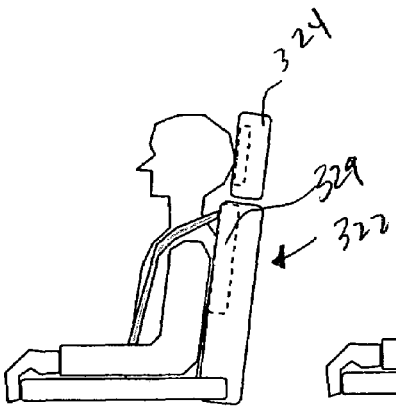
FIG. 15 is a side elevational view of a self-donning oxygen mask that may be stowed in a headrest, in a stowed configuration.
Figure 16:
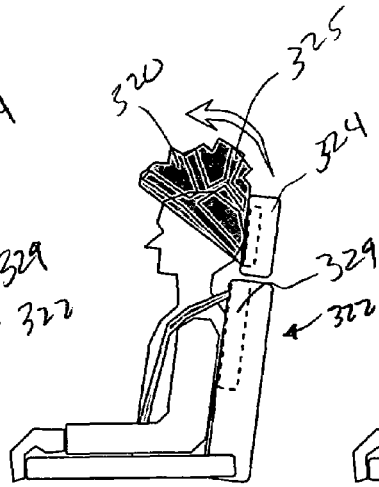
FIG. 16 is a side elevational view of the self-donning oxygen mask of FIG. 15, in a partially deployed configuration.
Figure 17:
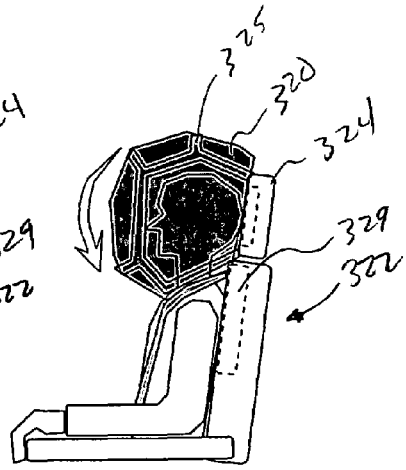
FIG. 17 is a side elevational view of the self-donning oxygen mask of FIG. 15, in a fully deployed configuration.
Figure 18:
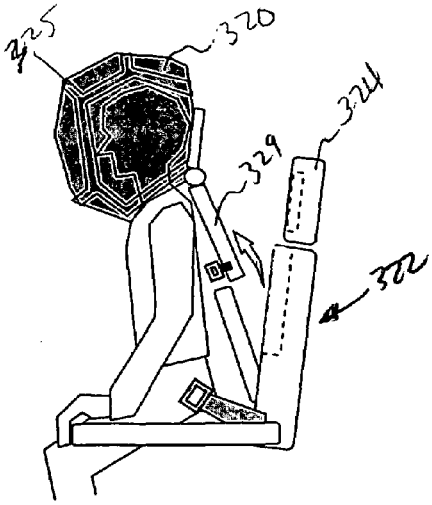
FIG. 18 is a side elevational view of the self-donning oxygen mask of FIG. 15, in a fully deployed configuration and partially detached from the headrest.
Figure 19:
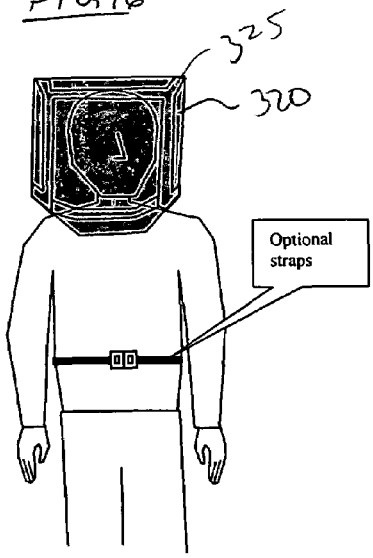
FIG. 19 is a front elevational view of the self-donning oxygen mask of FIG. 15, in a fully deployed configuration and with securing body straps installed.
Figure 20:
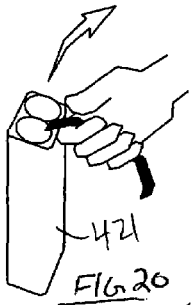
FIG. 20 is a perspective view of a self-inflating oxygen mask stowed in a container.
Figure 21:
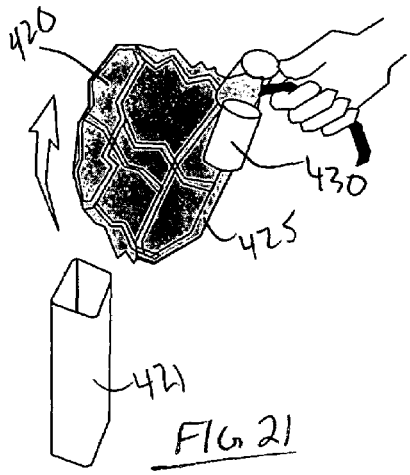
FIG. 21 is a perspective view of the self-inflating oxygen mask of FIG. 20, removed from the container and in a partially deployed configuration.
Figure 22:
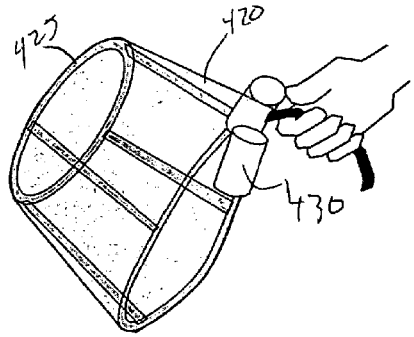
FIG. 22 is a perspective view of the self-inflating oxygen mask of FIG. 20, in a fully deployed configuration.
Figure 23:
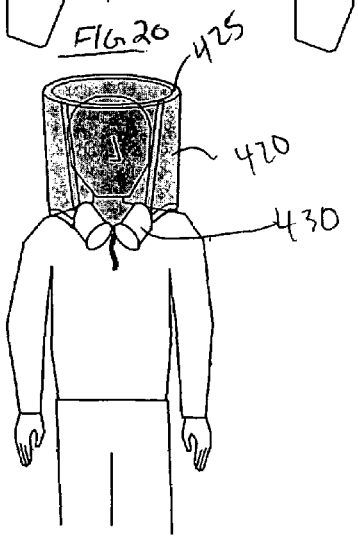
FIG. 23 is a front elevational view of the self-inflating oxygen mask of FIG. 20, in a fully deployed configuration and in an operational position over a head of a user.

In accordance with yet another embodiment of the invention, depicted in FIGS. 5 through 7, a transparent oxygen hood 120 may deploy from a pilot's shoulder harness 122.

The transparent oxygen hood 120 may be deployed in a single piece, as shown, or in a clamshell fashion similar to that depicted in FIG. 4. The transparent oxygen hood 120 may include inflatable tubes 125. The use of this embodiment may require the pilot wear the shoulder harness 122 continually when alone on the flight deck. The transparent oxygen hood 120, when stowed, may be integrated into the shoulder harnesses and/or seatbelts 122 or may be attached to the shoulder harnesses and/or seatbelts 122.

In accordance with yet another aspect of the invention, a transparent oxygen hood 220 may deploy from a lightweight chest pack 223 (shown in FIGS. 8 through 14 and similar to a front-pack baby carrier), seatbelt buckle, or other device worn by the pilot. Deployment may be similar to that of the embodiment depicted in FIGS. 5 through 7, except the pilot would be able to rise from his seat and take the transparent oxygen hood 220 with him. The seatbelt buckle or chest pack 223 is detachable from the seatbelts 222 allowing a user freedom of movement. This example also includes optional body securing straps 227 to keep the transparent oxygen hood 220 in place during movement.

With reference to FIGS. 15 through 19, a transparent oxygen hood 320 may be stowed in a pilot's seat 322, deploying from a head rest 324. The transparent oxygen hood 320 may include inflatable tubes 325. This embodiment may require that the pilot remain seated when alone in the flight deck.

The transparent oxygen hood 320 may deploy from a detachable backpack 329 nestled into the seat cushions instead of the headrest 324. After deployment the pilot may manually or automatically strap the backpack 329 on and detach it from the seat 322, thus allowing the pilot to rise from his seat 322 and take the transparent oxygen hood 320 with him. This embodiment may include body securing straps, 327, similar to the embodiment of FIGS. 8 through 14.

Another related concept for ease of use is a self-inflating, manually donned transparent oxygen hood 420, as shown in FIGS. 20 through 23. This system could replace existing Portable Breathing Equipment (PBE) used by airplane crews for fighting certain types of fires. Conventional PBE systems use a chemical oxygen generator that, once activated, cannot be deactivated and thus runs to depletion. Additionally, such chemical oxygen generators emit significant amounts of heat as a by product of the chemical reaction and this excess heat may become extremely uncomfortable for a user. In this concept, a crewmember needing emergency oxygen removes the flat, un-inflated transparent oxygen hood 420 from a container 421. Tubes 425 may be provided that inflate in the collar 430 and sides of the hood 420 to give it a helmet-like shape, enabling easy donning and wear.

This invention may also be used to provide self-donning transparent oxygen hoods for flight attendant seats. If such devices are supplied from detachable backpacks, flight attendants would be assured of ready access to oxygen-enriched air in the event of loss of pressurization, and their mobility to assist passengers would not be impaired. Of course, any or all of the embodiments may be constructed from fire proof or fire resistant materials to protect the face of the user from intense heat and/or fire.

Figure 24:
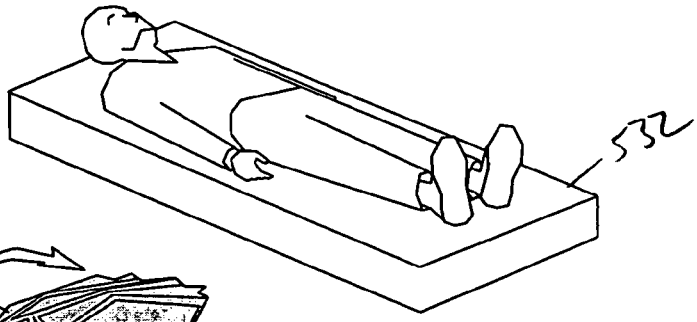
FIG. 24 is a perspective view of a self-donning oxygen mask stowed in a bed.
Figure 25:
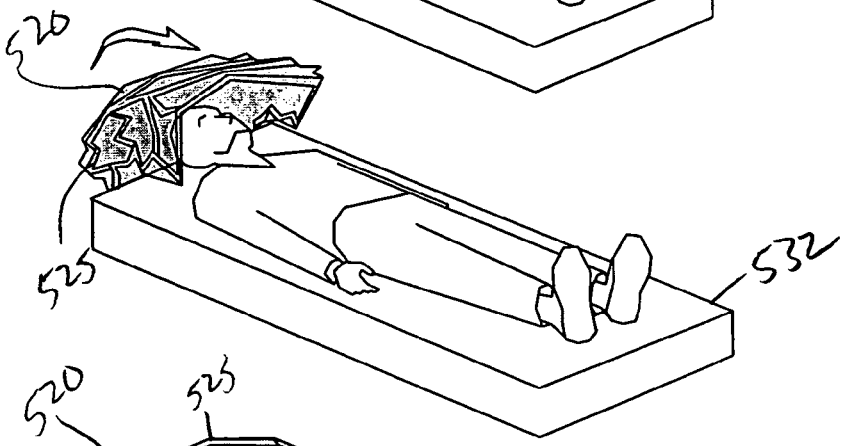
FIG. 25 is a perspective view of the self-donning oxygen mask of FIG. 24, in a partially deployed configuration.
Figure 26:
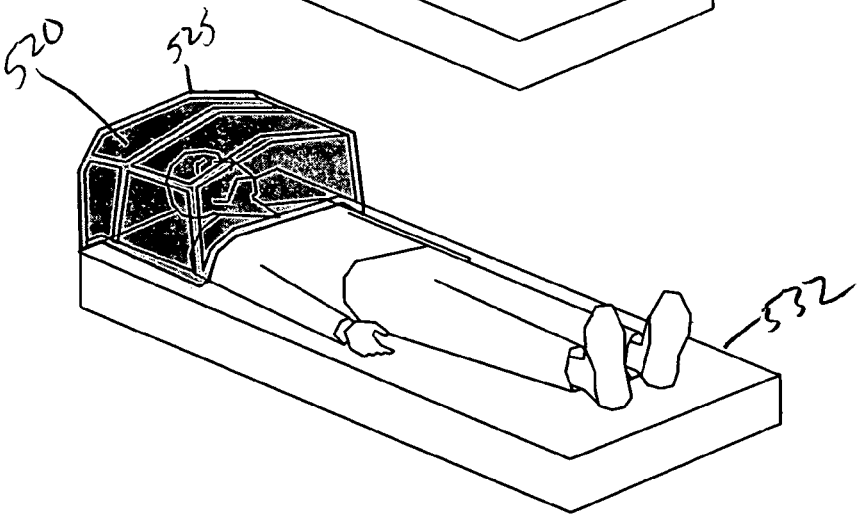
FIG. 26 is a perspective view of the self-donning oxygen mask of FIG. 24, in a fully deployed configuration.

This invention may also be used to provide self-donning transparent oxygen hoods 520 for crew rest seats and/or beds 532. This concept would ensure that a crew member seated or lying down during periods of crew rest would be supplied with oxygen-enriched air, for example, in the event of a loss of cabin pressure, even while sleeping, as shown in FIGS. 24 through 26. The transparent oxygen hood 520 may be stowed in one or both ends of the crew bed 532 or in the top of a crew rest seat (not shown). Alternately, the transparent oxygen hood 520 may be stowed in a bottom side of the crew bed 532. Regardless, upon detection of a loss of pressure, the flexible tubes 525 may inflate, similar to the previous embodiments. This example of the transparent oxygen hood 520 may be connected directly to an aircraft oxygen supply or a portable oxygen bottle stored near the crew bed 532 or seat. The transparent oxygen hood 520 extends, as the tubes 525 pressurize, sufficiently to cover the head area of a crew member lying in the bunk. The flexible tubes 525 when pressurized are sufficiently flexible to conform to the crew members body, thereby covering the crew member and able to accommodate a wide range of body sizes and/or shapes.

Figure 27:
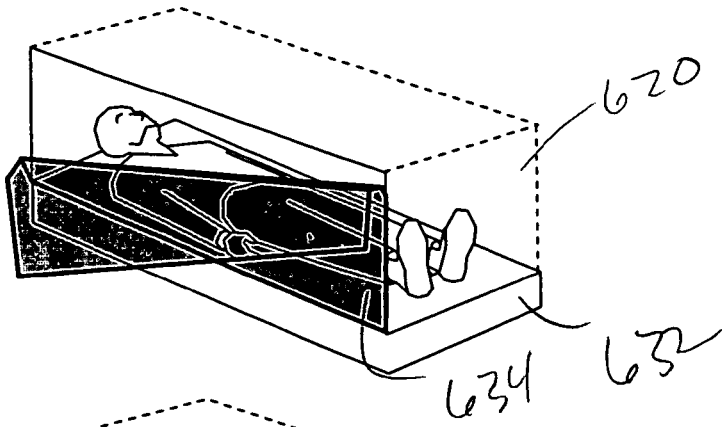
FIG. 27 is a perspective view of a self-inflating oxygen tent installed on a bed and in a partially open configuration.
Figure 28:
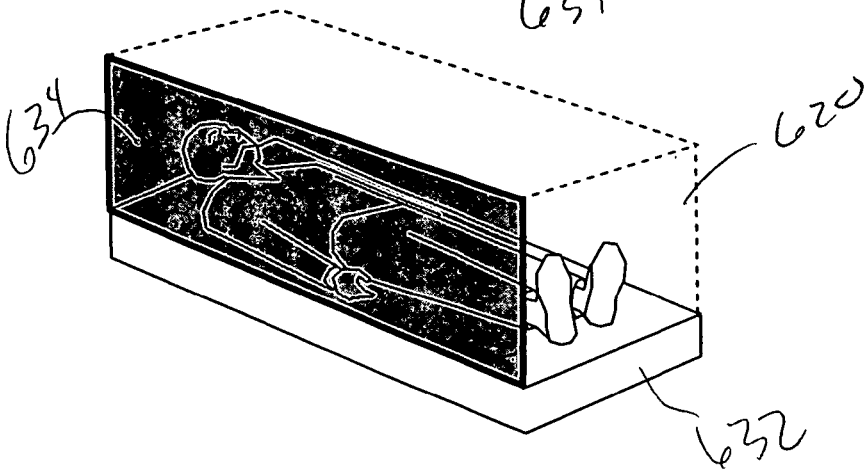
FIG. 28 is a perspective view of the self-inflating oxygen tent of FIG. 27, in a closed configuration.

A variation of the above concept would supply oxygen-enriched air directly to a crew rest bunk with a tent 620 as shown in FIGS. 27 through 28. A simple curtain 634 may be used to constrain the oxygen-enriched air to the bunk 632. The curtain 634 may be releasably secured to one or more sides of the tent 620 or to the bed 632. The curtain may be attached with a zipper, hook and loop fasteners, buttons or any other type of releasable securing device. The seal need not be air tight as discussed above.

A "dump and meter" system may be required to ensure rapid replacement of the air inside the hood or tent with oxygen-enriched air. This system would "dump" a large amount of oxygen for the first several seconds, followed by "metering" a slower flow of oxygen to maintain appropriate levels as the pilot breathes. A system of this sort may be required especially for the larger volume systems, such as the tent systems described above. Although, a "dump and meter" system may be used for the hood type systems as well. These "dump and meter" systems may also assist with deploying the inflatable tubes.

All of the above embodiments may be optionally provided with a control knob to allow the pilot to adjust the rate of flow and/or oxygen richness. Additionally, oxygen-enriched air may be released into the hood/tent through a dedicated valve, or by controlled leakage from the inflatable tubes.

The automatic deployment feature may include a wireless link to deploy the hood when smoke is detected on the flight deck by the airplane's avionics cooling system.

Other aspects and features of the present invention can be obtained from a study of the drawings, the disclosure, and the appended claims.

What is claimed is:

1. A system to protect a head of a person from a hazardous or undesirable ambient condition, comprising: a flexible hood adapted to be stowed in a small volume when the flexible hood is deflated and adapted to automatically cover at least a portion of the head of the person and to provide a safe environment to the person when the flexible hood is inflated; a sensor in fluid communication with the atmosphere in the vicinity of the flexible hood; a mechanism operatively connected to the sensor, and adapted to deploy the flexible hood when activated by the sensor.

2. The system of claim 1, wherein the person protected is an occupant on a pressurized aircraft.

3. The system of claim 1 wherein the hazardous condition is loss of pressurization.

4. The system of claim 1, wherein the sensor is designed to detect a loss of pressure.

5. The system of claim 1, wherein the safe environment within the hood is provided by a flow of at least one of oxygen, oxygen-enriched air, filtered air, and sterilized air.

6. The system of claim 1, wherein the flexible hood is made from a transparent material.

7. The system of claim 1, wherein the flexible hood includes inflatable tubes.

8. The system of claim 1, further including a radio headset, wherein the flexible hood is adapted to be stowed within the radio headset.

9. The system of claim 1, further including a shoulder harness, wherein the flexible hood is adapted to be stowed within the shoulder harness.

10. The system of claim 1, further including at least one of a seat and a headrest, wherein the flexible hood is adapted to be stowed within a portion of the at least one seat and headrest.

11. The system of claim 1, further including a bed, wherein the flexible hood is adapted to be stowed within a portion of the bed.

12. The system of claim 1, wherein the sensor is triggered by smoke or by other hazardous or undesirable ambient conditions.

13. A method of providing oxygen to an occupant of a pressurized aircraft, comprising: providing a flexible hood deflated and stowed in a small volume; sensing pressure of the atmosphere in the vicinity of the flexible hood using a pressure sensor; and automatically inflating and deploying the flexible hood to cover at least a portion of a head of the occupant and to automatically provide a flow of the oxygen to the occupant when the pressure sensor detects a condition for which inflating and deploying the flexible hood is desirable.

14. A system to protect at least a head of a person from a hazardous or undesirable ambient condition, comprising: a flexible, inflatable surface adapted to be stowed in a small volume when the flexible surface is deflated and adapted to cover at least a portion of a head of a person and to provide a safe environment to a person when the flexible surface is inflated; and a mechanism adapted to automatically deploy the flexible surface from a deflated state stowed in the small volume to an inflated state covering at least a portion of a head of a person.

15. The system of claim 14 wherein the system further includes a sensor in communication with the atmosphere.

16. The system of claim 15 wherein the mechanism is operatively connected to the sensor, and the sensor is adapted to deploy the flexible surface when the sensor detects at least one of a loss of pressure, smoke, or other undesirable ambient conditions.

17. The system of claim 14 wherein the flexible, inflatable Surface comprises at least one of a hood and a mask.

18. The system of claim 14 wherein the flexible, inflatable surface comprises at least one of a curtain and a tent.

19. The system of claim 14 wherein the flexible, inflatable surface when deflated is stowed in a small volume of at least one of a headset, a radio headset, a harness, a shoulder harness, a seat-belt, and a chest-pack.

20. The system of claim 14 wherein the flexible, inflatable surface when deflated is stowed in a small volume of at least one of a bunk, a bed, and a container.

21. The system of claim 14 wherein the mechanism is manually-donned.

22. The system of claim 14 wherein the person protected is an occupant on a pressurized aircraft and the hazardous condition is at least one of loss of pressurization and fire.

23. The system of claim 14 wherein the safe environment within the flexible surface is provided by a flow of at least one of oxygen, oxygen-enriched air, filtered air, and sterilized air.

24. The system of claim 14 wherein the surface is adapted to cover an entire body of a person when deployed.

25. The system of claim 14 wherein the surface is made from a transparent material.

26. The system of claim 14 wherein the flexible surface includes inflatable tubes.

27. The system of claim 1 wherein the person protected is an occupant on a pressurized aircraft, the hazardous condition is loss of pressurization, the sensor is designed to detect a loss of pressure, the safe environment within the hood is provided by a flow of at least one of oxygen, oxygen-enriched air, filtered air, and sterilized air, the flexible hood is made from a transparent material, and the flexible hood includes inflatable tubes.

28. The system of claim 27 wherein the flexible hood when deflated is stowed in a small volume of at least one of a bunk, a bed, and a container.

29. The system of claim 1, further including at least one of: (1) a headset, wherein the flexible hood is adapted to be stowed within the headset; (2) a radio headset, wherein the flexible hood is adapted to be stowed within the radio headset; (3) a harness, wherein the flexible hood is adapted to be stowed within the harness; (4) a shoulder harness, wherein the flexible hood is adapted to be stowed within the shoulder harness; (5) a seat-belt, wherein the flexible hood is adapted to be stowed within the seat-belt; and (6) a chest-pack, wherein the flexible hood is adapted to be stowed within the chest-pack.

30. The method of claim 13 wherein the providing step comprises providing the flexible hood deflated and stowed in the small volume of at least one of a headset, a radio headset, a harness, a shoulder harness, a seat-belt, and a chest-pack.

31. The method of claim 13 wherein the providing step comprises providing the flexible hood deflated and stowed in the small volume of at least one of a seat and a headrest.

32. The system of claim 14 wherein the flexible, inflatable surface when deflated is stowed in a small volume of at least one of a seat and a headrest.

* * * * *

UNITED STATES PATENT AND TRADEMARK OFFICE

CERTIFICATE OF CORRECTION

PATENT NO. : 7,607,434 B2
APPLICATION NO. : 11/196604
DATED : October 27, 2009
INVENTOR(S) : Laib et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 967 days.

Signed and Sealed this

Twelfth Day of October, 2010

David J. Kappos

David J. Kappos
*Director of the United States Patent and Trademark Office*